US005448951A

United States Patent [19]

Olson

[11] Patent Number: 5,448,951

[45] Date of Patent: Sep. 12, 1995

[54] RIGID, FRACTURABLE PROJECTILES FOR AIR POWERED GUNS

[76] Inventor: Christy L. Olson, 10732 Palatine N., Seattle, Wash. 98133

[21] Appl. No.: 202,597

[22] Filed: Feb. 28, 1994

Related U.S. Application Data

[60] Division of Ser. No. 4,193, Jan. 13, 1993, Pat. No. 5,353,712, which is a continuation of Ser. No. 808,205, Dec. 13, 1991, abandoned.

[51] Int. Cl.[6] ..... F42B 10/00

[52] U.S. Cl. ..... 102/513; 102/501; 102/517; 102/444; 106/213

[58] Field of Search ..... 106/213; 102/513, 501, 102/517, 444

[56] References Cited

U.S. PATENT DOCUMENTS

| | | | |
|---|---|---|---|
| D. 348,907 | 7/1994 | Prentice et al. | 102/501 |
| 4,656,092 | 4/1987 | Haman et al. | 428/402.2 |
| 4,738,724 | 4/1988 | Wittwer et al. | 106/213 |
| 4,819,609 | 4/1989 | Tippmann | 124/72 |

*Primary Examiner*—Thurman K. Page
*Assistant Examiner*—William E. Benston, Jr.
*Attorney, Agent, or Firm*—Graybeal Jackson Haley & Johnson

[57] ABSTRACT

A target shooting capsule comprising a non-toxic, biodegradable, injection molded shell of various shapes and forms having a dry wall thickness of from about 0.001 inches to about 0.1 inches, having a diameter from about 0.125 inches to about 1 inch, and containing a brightly colored water washable, non-toxic liquid dye fill material.

7 Claims, 2 Drawing Sheets

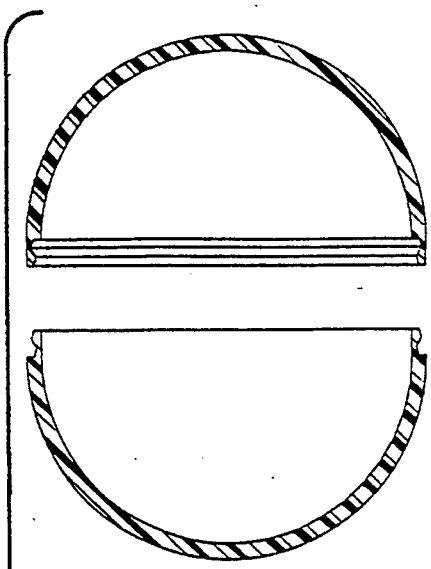
FIG. 1
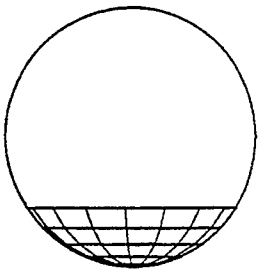
FIG. 2a
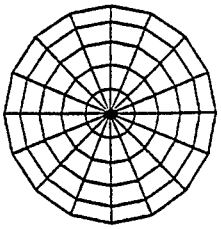
FIG. 2b
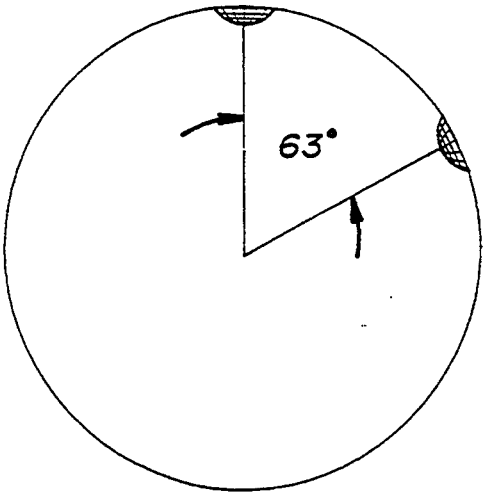
FIG. 2c
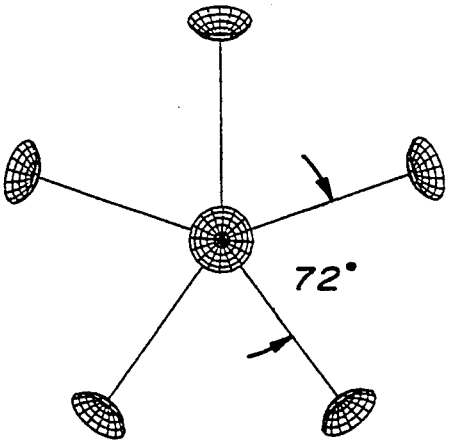
FIG. 2d
FIG. 5
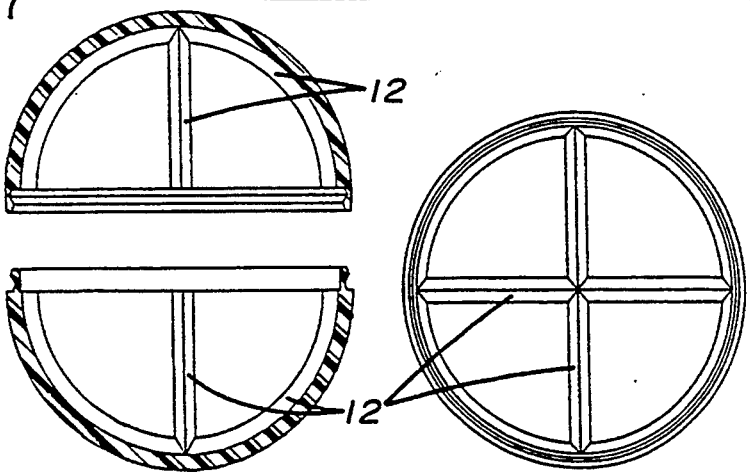

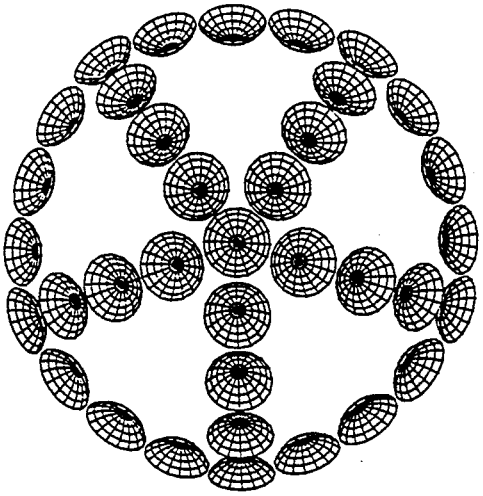
FIG. 2e
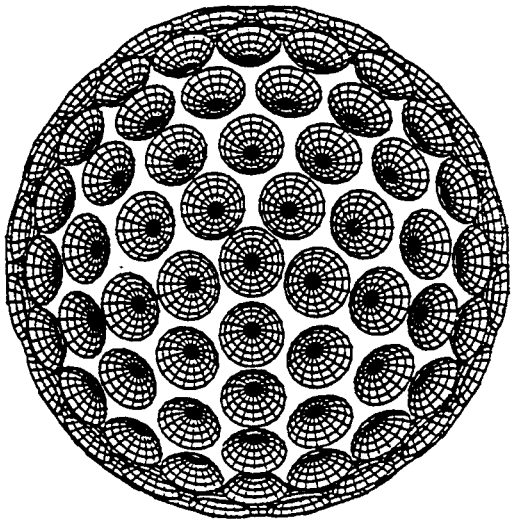
FIG. 2f
FIG. 3a
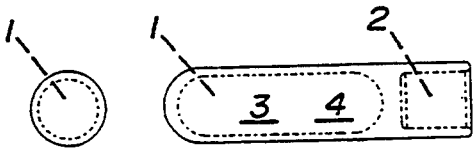
FIG. 3b
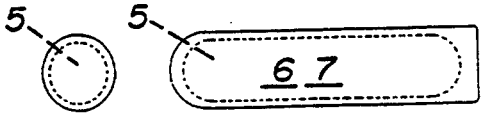
FIG. 4
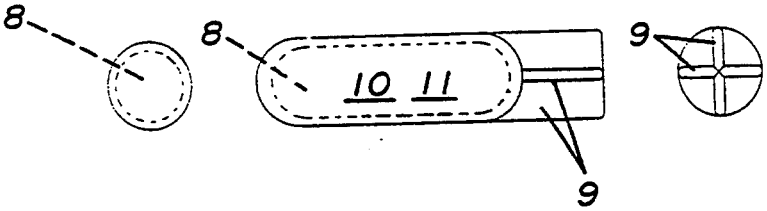
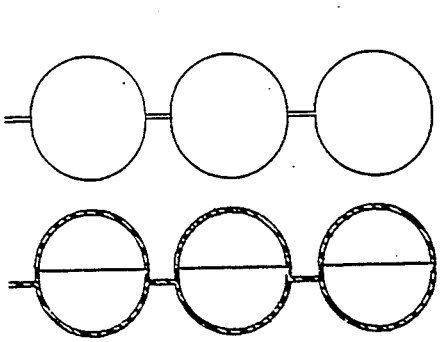
FIG. 6

RIGID, FRACTURABLE PROJECTILES FOR AIR POWERED GUNS

CROSS REFERENCE TO RELATED APPLICATIONS

This application is a divisional of prior application Ser. No. 08/004,193, filed Jan. 13, 1993, now U.S. Pat. No. 5,353,712 which is in turn a continuation of application Ser. No. 07/808,205, filed Dec. 13, 1991, and, now abandoned.

BACKGROUND OF THE INVENTION

1. Field of the Invention

This invention relates to a novel method of manufacturing target shooting capsules. It further relates to novel forms of target shooting capsules now made possible by this method of manufacture. These target shooting capsules are to be fired by air powered rifles or handguns in various recreational sports.

2. Description of Related Art

In recent years, a series of recreational sports has grown up around the use of air powered guns firing target capsules comprised of soft gelatin envelopes filled with non-toxic, washable liquid dyes. These capsules are referred to as "paintballs". The use of paintballs varies from target shooting to teams of people playing "Capture the Flag", to various pseudo and actual military training scenarios. By firing balls which break on impact and leave a stain, target impact may be determined in a safe and non-destructive fashion. In a large scale game it is not uncommon for one quarter million balls to be fired. Accordingly, one of the considerations is that the capsules and their fill must be inexpensive and readily biodegradable. The capsules must be sturdy enough to survive the stresses of being handled, carried and fired, but be fragile enough to break upon impact without causing bodily harm.

All paintballs known to the applicants are formed from the same process based upon the R. P. Sherer developed rotary die process for manufacturing soft elastic gelatin capsules. In this process flat sheets of heated gelatin are brought together in the center of a rotary die cutter/press. The dies cut out two circular patches of gelatin which are pressed together around the edges at a temperature which keeps them elastic while the resulting circular envelope is injected with liquid fill material under pressure. As the envelope fills, it is pressed against a forming cavity on the roller which gives it its final approximate shape. The injection-opening is sealed and the now assembled capsules are ejected and washed.

The original, and still predominant, use for the filled gelatin capsule process is to create pharmaceutical capsules for delivering liquid pharmaceuticals for internal use. Paintballs are manufactured on the identical equipment, and patents relating to paintballs have been issued relating to the fill contents and small modifications to the gelatin shell formulation, but not to the basic manufacturing process.

Paintballs produced by this process have certain characteristic problems. The pharmaceutical process is more concerned with the application of precise doses of fill material than with dimensional stability. The soft and elastic gelatin of the shells tends to be of a deformed shape. This problem is aggravated by the manufacturing stresses generated when two essentially flat sheets of gelatin are formed into an approximate spherical shape by fill pressure. For good aerodynamic flight characteristics, it is required that the capsules be as nearly spherical as possible. A large proportion of paintballs must be rejected at the manufacturer in order to deliver spherical paintballs. Further, the elastic gelatin is very susceptible to softening under elevated environmental temperature and humidity, which can aggravate any irregularities. Additionally, the elastic covering is comparatively susceptible to damage, causing jamming in feeding mechanisms and gun barrels. Additionally, because of the dimensional inaccuracy of the capsules, the air powered guns must be manufactured to accommodate out of round paintballs without jamming, which results in a slight but significant loss of efficiency in use of the portable compressed air containers employed to power paintball guns. Finally, soft elastic coatings can not support certain shapes that would improve the accuracy of target shooting capsules.

A second type of gelatin pharmaceutical capsule, in which two halves of a capsule are formed by dipping forms into a gelatin solution and then are assembled together with a fill material, is not suitable for use with liquid fills.

Very recently, an entirely new form of bio-degradable substance has been created by Warner-Lambert Company of Morris Plains, N.J. In U.S. Pat. No. 4,738,724 they describe a method for manufacturing pharmaceutical capsules using injection molding of starch based compounds.

SUMMARY OF THE INVENTION

It is therefore an object of this invention to provide a target shooting capsule ("paintball") that is more nearly and reliably spherical to increase the reliability and accuracy of shooting.

Another object is to manufacture the paintballs with a more uniform and reliable shell thickness, so that they will be less likely to burst in the gun barrel but will be more likely to burst upon impact with the target.

Another object is to manufacture paintballs with entirely novel shapes of capsule shells newly made possible by the use of injection molding, that will enhance their aerodynamic properties.

Another object is to create paintballs that are insensitive to environmental temperature and humidity when compared with standard soft gelatin paintballs.

Another object is to provide a shell and fill material that are non-toxic and biodegradable so as to be harmless in the event of accidental ingestion and to be environmentally safe.

Another object of the invention is to produce paintballs to much closer tolerances than hitherto possible, permitting more efficient guns to be used.

Further purposes and objects of the present invention will appear as the specification proceeds.

With the foregoing and other objects in view, the invention herein provides a target shooting capsule comprising a thermoplastic injection molded starch based non-toxic shell filled with various water washable, intensely colored, non-toxic liquids. Various shapes, from spherical to complex, and various surface patterning, made possible for the first time by use of the stiffer and dimensionally stable injection molded starch based shell of this invention, are specified to improve the shooting characteristics of target shooting capsules. Such improvements include greater accuracy and longer travel with the identical muzzle velocity of standard paintballs.

BRIEF DESCRIPTION OF THE DRAWINGS

Further benefits and advantages of the invention will become apparent from a consideration of the following description given with reference to the accompanying drawing figures which specify and show preferred embodiments of the present invention.

FIG. 1 is a cross-sectional view of a two piece spherical capsule shell with a locking mechanism according to the present invention;

FIGS. 2 (*a–f*) are respectively: a side view of the layout of a preferred dimple layout, a top view of a dimple, a side view of the preferred layout of the first two dimples on the capsule, the preferred layout of the first six dimples on a capsule, the preferred layout of the first 36 dimples on a capsule, the completed layout of dimples on a capsule;

FIGS. 3 (A–B) are end and side views of bullet shaped capsules;

FIG. 4 is end and side views of a capsule with fins;

FIG. 5 is a cross-sectional side view of two parts of an incised spherical capsule and a top view looking into the bottom part of the capsule;

FIG. 6 shows a cross-sectional side view and a top view of multiple capsules with physical links.

DETAILED DESCRIPTION OF THE PREFERRED EMBODIMENTS

The present invention concerns a non-toxic biodegradable thermoplastic injection molded capsule which is useful as a replacement for soft gelatin capsules in recreational target shooting with air powered rifles and handguns. The capsules are filled with a non-toxic brightly colored washable fluid dye. The capsules are suitable for either passive target shooting or use in team combat simulations. The capsules are chemically safe if accidentally ingested, will naturally decompose on the playing field, and will cause no impact damage to individuals when used according to nationally accepted playing rules.

The capsules are manufactured of materials and processes stated in Warner-Lambert U.S. Pat. No. 4,738,724. These procedures permit the creation of highly dimensionally stable capsules that can have complex molded components permitting the manufacture of superior target capsules. The present invention concerns the shapes, sizes and forms which constitute such superior capsules.

The Warner-Lambert capsules are preferably injection molded from a starch and water compound for pharmaceutical use, and accordingly are non-toxic and bio-degradable. By the appropriate use of additive materials, as specified in their patent, the stiffness and sensitivity of the capsule to humidity may be adjusted. For filler, any non-toxic non-water based liquid capable of carrying a washable bright dye is suitable, preferably vegetable or mineral oil.

FIG. 1 shows the basic embodiment of an alternative form of a standard paintball. It is dimensionally spherical to about 1% variance. While the preferred external diameter corresponds to the most common standard of 0.68 inches in diameter to a tolerance of ±0.007 inches, for use as target capsules as envisioned in this invention the spheres may be of a size from about 0.125 inches to about one inch, depending upon the gun to be used. The thickness of the capsule dry wall is variable according to the precise properties of the starch formulation being used. The thickness is determined by tests to be that sufficient to hold the capsule intact under firing stress while readily bursting upon impact with the target. Such a thickness will vary between approximately 0.002 and 0.1 inches. The capsule is formed in two halves with a typical locking mechanism such as is found in the previously mentioned patent. Other locking mechanisms are possible in the scope of this invention. Because of the dimensional instabilities of standard gelatin paintballs, the barrels of guns designed to fire standard paintballs are machined slightly oversize to help prevent paintballs jamming in the barrels and bursting. The present invention will include paintballs precisely molded and sized. The invention therefore includes balls manufactured in precise size increments above the standard 0.68 inches to permit more efficient firing in existing oversized guns with the portable air supplies used in paintball sports. Additionally, the provision of precisely sized paintballs will allow precisely machined new barrels to be efficiently produced.

FIG. 2 shows the embodiment of an improved spherical paintball capsule consisting of a dimpled surface. Such a surface configuration is not possible in the elastic surface of gel capsules using standard gel capsule manufacturing techniques. Tests conducted by the applicant with wax balls demonstrate several improvements in flight characteristics using such a dimpled surface. Firstly, the balls travel 2% to 3% further with a dimpled surface, and secondly, the accuracy of the flights is improved, with a spread circumference of ten balls at 50 feet being 4% to 8% smaller in diameter using the test balls. Tests show improvements with virtually any surface roughness, with the best results obtained with the illustrated preferred dimple configuration. The illustrated configuration provides the most complete surface coverage by dimples while maintaining a regular pattern that will not cause the paintball to tumble. The improvement in flight characteristics is achieved by delaying the onset of laminar flow about the sphere in flight, thus reducing drag and lift. The dimple pattern is achieved by inscribing an icosohedron inside the sphere, resulting in twelve vertex points evenly spaced about the surface of the sphere. If the vertex points are joined with lines along the surface of the sphere, then twenty identical equilateral spherical triangles result covering the entire surface of the sphere. Dimple placement is as follows: a single dimple is placed on each vertex point, following which a number of dimples is placed along each imaginary spherical line connecting the vertices, with the preferred number being three, following which the triangular spaces between the lines of dimples are all filled identically by a number of dimples in triangular array, with the preferred number again being three. The resulting dimple pattern, illustrated in FIGS. 2*a* through 2*f*, will provide for the maximum coverage of the spherical surface with dimples, while creating a minimum tendency to tumble due to the symmetry of patterning. While the illustration shows the preferred surface embodiment in detail, it should be understood that this form of surface roughness is illustrative only and this invention is not necessarily limited thereto.

FIG. 3 shows the embodiment of new forms of paintball capsules with a bullet shape. Such a shape is not possible with sufficient dimensional stability in gel capsules to be useful. With the stiffer material and dimensional stability of the thermoplastic starch capsules, bullet shapes may be made that will load better and fly truer. By varying the thickness and form of the capsule ends and the density of the fill material aerodynamic stability can be enhanced by shifting the center of pressure behind the center of gravity. FIG. 3B shows an internal chamber 1 that contains fill material, a cavity 2 open to the air, a center of gravity 3 that lies in front of the center of pressure 4. FIG. 3B shows an internal chamber 5 with a thick rear wall which, with a dense fill material, causes the center of gravity 6 to lie in front of the center of pressure 7.

FIG. 4 shows the embodiment of a bullet shaped capsule with an internal chamber 8 containing fill material and molded fins 9, which cause the center of gravity 10 to lie in front of the center of pressure 11. Such a shape is possible for the first time with the injection molding techniques used in this invention.

FIG. 5 shows the embodiment of a spherical capsule with molded depressed lines 12, either on the outer or inner surface, which will encourage the capsule to break apart upon striking the target. The thicker portions of skin will absorb surface damage during rough handling, while the thinner rays of material will readily separate upon impact.

FIG. 6 shows the embodiment of multiple rounds of paintballs molded together for rapid feeding into a rapid firing paintball gun. This technique is applicable to any shape of capsule. Instead of the gravity feed used in standard guns, a rapid feed is possible using mechanical assistance to pull the rounds into position. As part of the loading action, the links are severed once the round is in place in the receiver.

It will be appreciated that the preceding descriptions and examples of the invention are examples only, and that further improvements may be apparent from this disclosure and may be resorted to without departing from the spirit of this invention, as those skilled in the art will readily understand.

I claim:

1. A target shooting capsule manufactured by an injection molded process in combination with an air powered gun, said capsule comprising:

a hardened outer shell, said shell formed by a process involving the injection of a melted starch and water compound into a mold under elevated temperatures and pressure, said molded compound curing into said hardened outer shell;

a liquid fill material inserted into said hardened outer shell, said fill material being non-toxic and carrying washable dye;

a means to enclose said fill material within said hardened outer shell;

said air powered gun having a barrel for holding and shooting said capsule from said gun to a target.

2. A projectile for an air powered gun comprising:

a rigid body shell of sufficient strength to not fracture on being discharged from the gun but not of sufficient strength to not fracture on impact with a target, said rigid body shell being formed of injection molded plasticized water soluble starch with a dimpled surface and with negligible reversible elastic deformation and an ASTM Shore-Durometer hardness in the range from 30 to 80, said projectile further comprising a non-toxic target marking material contained within said rigid body shell.

3. A projectile of claim 2, wherein said rigid body shell has a rough exterior surface.

4. A projectile according to claim 2, wherein said rigid body shell has a thickness in the range from 0.002 to 0.1 inch.

5. A projectile according to claim 2, wherein said rigid body shell is essentially spherical with the diameter in the range of from 0.125 to 1.0 inch.

6. A projectile according to claim 2 of bullet form.

7. A projectile according to claim 2, comprising stabilizing fins.

* * * * *